US008603263B2

(12) United States Patent
Kaminaka et al.

(10) Patent No.: US 8,603,263 B2
(45) Date of Patent: Dec. 10, 2013

(54) DUPLEX STAINLESS STEEL HAVING EXCELLENT ALKALI RESISTANCE

(75) Inventors: Hideya Kaminaka, Nishinomiya (JP); Junichi Higuchi, Nishinomiya (JP); Yoshiaki Yamade, Narashino (JP); Shuuji Yoshida, Joetsu (JP); Junko Imamura, Amagasaki (JP)

(73) Assignee: Nippon Steel & Sumitomo Metal Corporation, Tokyo (JP)

( * ) Notice: Subject to any disclaimer, the term of this patent is extended or adjusted under 35 U.S.C. 154(b) by 0 days.

(21) Appl. No.: 13/461,379

(22) Filed: May 1, 2012

(65) Prior Publication Data

US 2012/0244031 A1 Sep. 27, 2012

Related U.S. Application Data

(63) Continuation of application No. PCT/JP2010/070115, filed on Nov. 11, 2010.

(30) Foreign Application Priority Data

Nov. 13, 2009 (JP) ..... 2009-260119

(51) Int. Cl.
*C22C 38/44* (2006.01)

(52) U.S. Cl.
USPC ..... 148/325; 148/327; 148/656

(58) Field of Classification Search
USPC ..... 148/325, 327, 608–610, 655, 656; 420/52, 57, 67
See application file for complete search history.

(56) References Cited

U.S. PATENT DOCUMENTS

| | | | | |
|---|---|---|---|---|
| 4,604,887 | A * | 8/1986 | Ohtsubo et al. | 72/368 |
| 2003/0155046 | A1 * | 8/2003 | Yamadera et al. | 148/327 |

FOREIGN PATENT DOCUMENTS

| | | |
|---|---|---|
| JP | 51-80611 | 7/1976 |
| JP | 11-293406 | 10/1999 |
| JP | 2003-095989 | 4/2003 |
| JP | 2003-301241 | 10/2003 |
| JP | 3620256 | 11/2004 |
| JP | 2007-146202 | 6/2007 |

OTHER PUBLICATIONS

Journal of the Japan Institute of Metals, vol. 43, No. 6, pp. 527-531, Jun. 1979.
Journal of the Japan Institute of Metals, vol. 44, No. 5, pp. 582-585, May 1980.

* cited by examiner

*Primary Examiner* — Deborah Yee
(74) *Attorney, Agent, or Firm* — Clark & Brody

(57) ABSTRACT

The present invention provides a duplex stainless steel having excellent resistance to alkalis and particularly corrosion resistance against high-temperature concentrated alkali solutions and excellent weldability. The duplex stainless steel has a chemical composition comprising, in mass %, C: at most 0.03%, Si: at most 0.5%, Mn: at most 2.0%, P: at most 0.04%, S: at most 0.003%, Cr: at least 25.0% to less than 28.0%, Ni: at least 6.0% to at most 10.0%, Mo: at least 0.2% to at most 3.5%, N: less than 0.5%, W: at most 3.0%, and a remainder of Fe and impurities.

10 Claims, 2 Drawing Sheets

DUPLEX STAINLESS STEEL HAVING EXCELLENT ALKALI RESISTANCE

TECHNICAL FIELD

This invention relates to a duplex stainless steel having excellent alkali resistance and in particular excellent corrosion resistance to high-temperature concentrated alkali solutions.

BACKGROUND ART

Materials used to construct various types of chemical plants need to have excellent corrosion resistance in addition to a sufficient strength. The specific type of corrosion resistance which is required varies with the type of plant, with acid resistance sometimes being required and alkali resistance at other times being required.

As an example of alkali resistance, materials used to construct electrolytic soda plants need to have resistance to a high-temperature concentrated alkali environment.

Examples of materials having such resistance are pure Ti, Ti alloys, and pure Ni. However, each of these is an expensive metal, and they are not practical for use in large-scale plants. Therefore, it is common to use stainless steel, which is relatively inexpensive. However, corrosion resistance of stainless steel is not sufficient compared to that of the above-described metals. Therefore, operation of this type of plant entails frequent replacement of plant components made of stainless steel. Because this replacement is accompanied by a decrease in productivity and an increase in product costs, there is a demand for a stainless steel having excellent corrosion resistance.

A stainless steel which can be applied in a high-temperature concentrated alkali environment is a ferritic stainless steel having a high Cr content (see, for example, Non-Patent Documents 1 and 2). An example of such a stainless steel is SUS 447J1 (30Cr-3Mo). However, a stainless steel having a high Cr content of around 30 mass % is poorly available because it is difficult to manufacture, and even if it can be obtained, it has poor workability when it is used for the construction of plant equipment. Therefore, it undergoes marked deterioration in corrosion resistance, particularly in welds. In light of such problems, it is not being widely used.

Under relatively mild conditions in a high-temperature concentrated alkali environment, demands with respect to corrosion resistance are lower and it is possible to use a material having excellent workability. Under these conditions, certain duplex stainless steels are sometimes used. For example, Patent Document 1 states that SUS 329J4L is suitable. However, this material cannot be said to have sufficient corrosion resistance in a high-temperature concentrated alkali environment.

PRIOR ART DOCUMENTS

Patent Documents

Patent Document 1: JP 3,620,256 B

Non-Patent Documents

Non-Patent Document 1: Journal of the Japan Institute of Metals, Vol. 43, No. 6, pages 527-531

Non-Patent Document 2: Journal of the Japan Institute of Metals, Vol. 44, No. 5, pages 582-585

DISCLOSURE OF INVENTION

The object of the present invention is to provide a duplex stainless steel having excellent alkali resistance and particularly excellent corrosion resistance to high-temperature concentrated alkali solutions.

In one embodiment, the present invention, which is provided for solving the above-described problems, is a duplex stainless steel for use in applications requiring alkali resistance having a chemical composition which comprises, in mass %, C: at most 0.03%, Si: at most 0.5%, Mn: at most 2.0%, P: at most 0.04%, S: at most 0.003%, Cr: at least 25.0% to less than 28.0%, Ni: at least 6.0% to at most 10.0%, Mo: at least 0.2% to at most 3.5%, N: less than 0.5%, W: at most 3.0%, and a remainder of Fe and impurities, said duplex stainless steel having been subjected to rolling with the average transverse grain diameter of austenite grains in a rolling stretcher section (a cross section including the thickness direction of the stainless steel and the lengthwise direction of rolling) being at most 350 μm.

The duplex stainless steel preferably has at least one of the following features:

- the duplex stainless steel has a ferrite content of at least 40 mass %; and
- the number of ferrite phases present in a region from the surface of the duplex stainless steel to a depth of 0.5 mm from the surface (the surface region) is at least 15.

The present invention provides a duplex stainless steel having excellent durability even in a high-temperature concentrated alkali environment typified by electrolytic soda plant or the like. Moreover, a stainless steel according to the present invention does not readily produce significant problems when subjected to construction processes such as welding (such as excessive hardening of welds). Therefore, steel members made from a stainless steel according to the present invention (exemplified by tubular materials such as seamless pipes and welded pipes, sheet materials such as foil, thin sheets, and plates; ingots; bar stock; and members resulting from secondary working (cutting or machining, bending, drilling or punching, welding, and the like) of these materials) can be suitably used in chemical plants having a high-temperature concentrated alkali environment. Examples of specific products for use in these applications are piping, vessels, valves, mesh, and support structures for these members.

MODES FOR CARRYING OUT THE INVENTION

Figure 1:
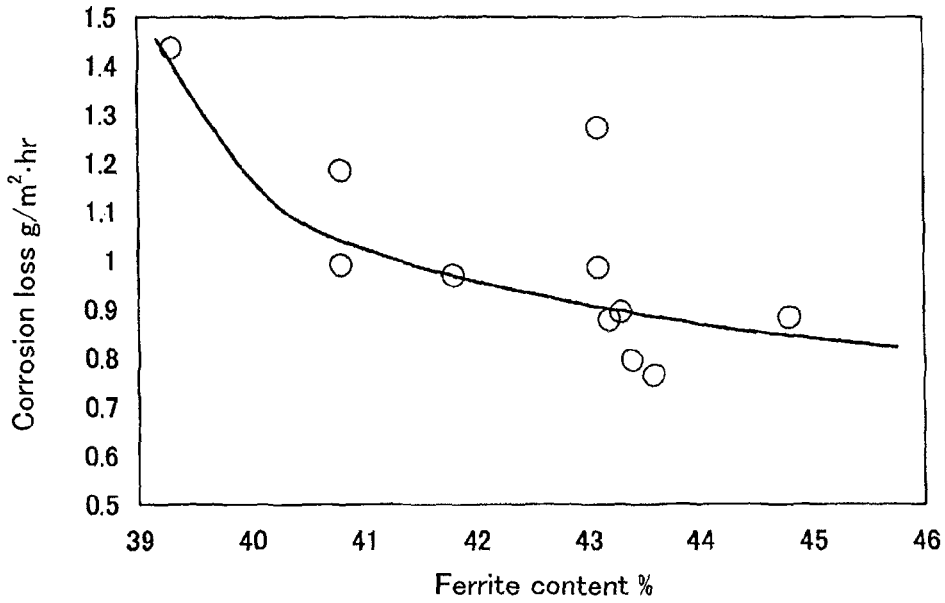
FIG. 1 is a graph showing the dependence of the corrosion weight loss on the ferrite content in a test steel sheet of Example 1.

A duplex stainless steel having excellent alkali resistance according to the present invention will be explained below.

1. Chemical Composition

A duplex stainless steel according to the present invention has a chemical composition comprising C: at most 0.03%, Si: at most 0.5%, Mn: at most 2.0%, P: at most 0.04%, S: at most 0.003%, Cr: at least 25.0% to less than 28.0%, Ni: at least 6.0% to at most 10.0%, Mo: at least 0.2% to at most 3.5%, N: less than 0.5%, W: at most 3.0%, and a remainder of Fe and impurities.

Below, each element will be explained in detail. Percent with respect to the content of steel components means mass percent.

C: at most 0.03%

C is an austenite-forming element and is effective at increasing strength. However, if the C content is too high, precipitation of various types of carbides which have an effect on workability and corrosion resistance occurs. Therefore, in order to suppress the formation of carbides, the C content is made at most 0.03%. A preferred C content is at most 0.020%.

Si: at most 0.5%

Like Al, Si is an effective deoxidizing element in mass produced steel, but if its content is too high, it has a tendency to decrease corrosion resistance and formability. Accordingly, the Si content in the steel is made at most 0.5%. There is no particular lower limit on the Si content, but deoxidation may become inadequate if it is less than 0.01%. A preferred Si content is in the range of at least 0.05% to at most 0.3%.

Mn: at most 2.0%

Mn is an effective austenite phase-stabilizing element. If the Mn content is at most 2.0%, the higher its content, the more austenite phases are stabilized. However, if the Mn content exceeds 2.0%, the stability of austenite phases does not increase in proportion to the increase in the Mn content. Moreover, if its content is too high, it may cause a decrease in corrosion resistance. Accordingly, Mn is contained in the range of at most 2.0%. From the standpoint of economically increasing the effect of stabilizing austenite phases, the Mn content is preferably in the range of at least 0.3% to at most 1.7%.

P: at most 0.04%

The content of P in steel is made at most 0.04%. In a steel according to the present invention, P and S are the most harmful impurities. The lower its content the better.

S: at most 0.003%

The content of S in steel is made at most 0.003%. In a steel according to the present invention, S and P are the most harmful impurities, so the S content is preferably as low as possible. Depending upon the type and content of other elements present in steel and the S content, S is almost entirely precipitated in steel as non-metallic inclusions such as Mn-based sulfides, Cr-based sulfides, Fe-based sulfides, complex sulfides of these sulfides, and complex nonmetallic inclusions with oxides. Each of these S-containing non-metallic inclusions acts as a starting point for corrosion, although there are variations with respect to extent. Therefore, S is harmful with respect to maintaining a passive film and maintaining the corrosion-suppressing ability of steel. The S content in usual mass produced steel is greater than 0.005% to at most 0.008%, but in order to prevent the above-described harmful effects of S, the S content in a steel according to the present invention is lowered to at most 0.003%. A preferred S content is at most 0.002%, and a most preferred S content is less than 0.001%, with the lower the content better. Making the S content less than 0.001% in mass production on an industrial scale produces only a slight increase in manufacturing costs with present-day refining technology, and this level can be easily achieved.

Cr: at least 25.0% to less than 28.0%

Cr is one of the main constituent elements in a passive film, so it is an important element for guaranteeing corrosion resistance. When the Cr content is too low, corrosion resistance decreases. Accordingly, its content is made at least 25.0%. Since Cr is a ferrite-forming element, if the Cr content is 28.0% or above, the austenite phases becomes unstable no matter how the other alloying elements are adjusted, and as a result, it becomes difficult to stably obtain a duplex structure. Furthermore, some additional problems may develop. For example, it becomes easy for the steel to be affected by the heat of welding and the hardness of welds may become excessively high, and ridging due to non-uniform deformation of ferritic grains during hot working may occur. Accordingly, the Cr content is made at least 25.0% to less than 28.0%. A preferred Cr content is at least 26.0% to less than 28.0%.

Ni: at least 6.0% to at most 10.0%

Ni is an austenite-forming element. In order to stably obtain a duplex structure having excellent alkali resistance and excellent workability, the Ni content is made at least 6.0%. However, if the Ni content is excessive, steel making becomes difficult, and resistance to high-temperature concentrated alkalis ends up decreasing. Accordingly, the upper limit on the Ni content is made 10.0%. A preferred range for the Ni content is at least 6.0% to at most 9.5%.

N: less than 0.5%

N is an austenite-forming element, so it is effective at adjusting the balance of austenite phases. In addition, N contributes to an increase in corrosion resistance. However, if the N content is excessive, workability may decrease due to the formation of blowholes during welding or the formation of nitrides. Accordingly, the N content is made less than 0.5%. There is no particular lower limit on the N content. From the standpoint of stably obtaining the above-described effects from N, the N content is preferably made greater than 0.30%.

Mo: at least 0.2% to at most 3.5%

Mo is a ferrite-forming element, and in a duplex stainless steel, it is an alloying element which improves corrosion resistance and particularly anti-pitting properties. Accordingly, the Mo content is made at least 0.2%. However, if the Mo content is excessive, it becomes difficult to avoid precipitation of intermetallic compounds such as sigma phases. If intermetallic compounds precipitate, embrittlement of steel becomes marked, and as a result, there may be problems such as difficulty in carrying out production and a marked decrease in the corrosion resistance of welds. Accordingly, the upper limit on the Mo content is made at most 3.5%. A preferred range for the Mo content is at least 0.5% to at most 3.0%.

W: at most 3.0%

Like Mo, W has the effect of improving corrosion resistance. From the standpoint of stably obtaining this effect of W, its content is preferably made at least 0.1%. However, if the W content is excessive, problems such as a decrease in workability and an increase in the influence of weld heat resulting in an excessive increase in the hardness of welds may develop. Accordingly, the upper limit on the W content is made 3.0%. From the standpoint of achieving both a high level of corrosion resistance and workability, the total of the W content and the Mo content is preferably at least 1.0% to at most 5.0%.

The remainder other than the above-described elements is Fe and impurities. Here, impurities mean elements which are unavoidably incorporated into steel during its production. Examples of such impurities are Al, O, and the like. Examples of the ranges of these impurities are Al (acid soluble Al): at most 0.025% and O (total oxygen concentration in the steel): at most 0.010%.

2. Metallurgical Structure

Because a stainless steel according to the present invention is a duplex stainless steel, it comprises ferrite phases and austenite phases. In an alkali environment, the austenite phases are corroded in preference to the ferrite phases. Therefore, from the standpoint of increasing resistance to alkalis and particularly corrosion resistance to high-temperature concentrated alkali solutions, it is preferable for the content of the austenite phases (in mass %) to be small and for the content of the ferrite phases (in mass %, referred to as the ferrite content in the present invention) to be large. If the ferrite content is excessively small, due to corrosion of the austenite phases, the remaining ferrite phases fall off and large-scale corrosion develops. Accordingly, the ferrite content is preferably at least 40 mass %. A more preferred ferrite content is at least 43 mass %. The ferrite content can be measured using known measuring equipment.

From the standpoint of obtaining excellent corrosion resistance, the number of ferrite phases (referred to as the ferrite phase number in the present invention) present in a region from the surface of the duplex stainless steel to a depth of 0.5 mm from the surface (referred to as the surface region in the present invention) is preferably at least 15. A method of measuring the ferrite phase number will be explained with respect to a stainless steel sheet taken as an example.

A stainless steel sheet is cut so as to have a cut cross section including the thickness direction and the rolling direction of the stainless steel sheet. In the present invention, a cross section including the thickness direction and the rolling direction of stainless steel obtained by working including a rolling step is referred to as a rolling stretcher section. By further cutting the stainless steel sheet having a rolling stretcher section, a sample for observation including a rolling stretcher section in the surface region is obtained. The sample for observation is subjected to pretreatment such as embedding in a resin, and the rolling stretcher section in the surface region is subjected to polishing and etching by known methods to make it possible to observe this surface (below, the rolling stretcher section in the surface region which was made observable is referred to as an observation surface). An arbitrary point on the surface of the steel sheet in this observation surface is selected as a starting point for measurement. A point which is spaced from the starting point for measurement by 0.5 mm towards the center in the thickness direction of the steel sheet is made the end point for measurement. A line connecting the starting point for measurement and the end point for measurement is set as a measurement line, and the number of ferrite phases which cross this measurement line is countered as the ferrite phase number. The steel sheet is determined to have excellent corrosion resistance if the ferrite phase number is at least 15.

Specifically, using an electron microscope, this observation surface is continuously observed in the thickness direction at a magnification of 400×, for example, and the resulting plurality of observation images are connected to prepare an image including a cross section of the surface region. An arbitrary starting point for measurement is selected in this image, and the ferrite phase number can be found by the above-described method. It is possible to select a plurality of starting points for measurement in one observation surface, to find a plurality of ferrite phase numbers along a plurality of measurement lines in this observation surface, and to take the average of the resulting values of ferrite phase number. From the standpoint of further increasing the reliability of the result of measurement, at least 5 different measurement lines can be set in one observation surface, at least 5 ferrite phase numbers can be found along these at least 5 measurement lines, and the arithmetic mean of the ferrite phase numbers can be found for at least 3 ferrite phase numbers obtained by excluding the smallest and largest numbers.

When the austenite phases are small, they have less effect on the ferrite phases when the austenite phases are corroded. Accordingly, the shape of the austenite phases is preferably such that the average transverse grain diameter of austenite grains observed in a rolling stretcher section of a stainless steel sheet is at most 350 μm. There is no particular limitation on a method of measuring the average transverse grain diameter of austenite grains in a stainless steel sheet. One example of a method of measuring in a stainless steel sheet is as follows. A portion of the observation surface in the rolling stretcher section obtained by the above-described method is observed with an electron microscope at a magnification of 200×, for example, and the length of the major axis of at least 5 austenite grains in one field of view is measured. Of the data for the at least 5 major axes which were measured, the smallest and largest values are excluded, and the arithmetic mean of the remaining values (at least 3 data points) is calculated and taken as the average transverse grain diameter of austenite grains. From the standpoint of further increasing the reliability of data on the average transverse grain diameter, a plurality of rolling stretcher sections can be prepared for one steel sheet, a plurality of measurements of the average transverse grain diameter can be obtained by observing the observation surfaces obtained from these rolling stretcher sections, the arithmetic mean of these measurements can be calculated, and this can be made the average transverse grain diameter for the steel sheet.

3. Manufacturing Method

As long as the above-described characteristics of steel composition are satisfied, a stainless steel sheet according to the present invention can be manufactured in the form of a duplex stainless steel having excellent alkali resistance and particularly excellent corrosion resistance to a high-temperature concentrated alkali solutions and excellent weldability (which does not excessively harden due to heating at the time of welding) by a manufacturing method typically carried out for the manufacture of stainless steel. However, by employing the below-described manufacturing method, a stainless steel sheet having the above-described preferred characteristics of metallurgical structure can be stably obtained.

(1) Melting

There are no particular limitations on melting. Based on known techniques, raw materials can be melted using a vacuum induction melting furnace or the like, for example, and a stainless steel material having a desired steel composition can be prepared.

(2) Forging

Forging is carried out on a steel material made from molten stainless steel prepared by melting. This steel material may be directly supplied to forging from a melting step, or the molten stainless steel may be first cooled in a prescribed shape and then heated and forged. A forging temperature higher than 1200° C. is desirable from the standpoint of increasing the volume percent of ferrite phases in the stainless steel sheet to be manufactured.

There is no particular limitation on the amount of reduction in forging. It is desirable that the amount of reduction be large and working be carried out in all directions, since austenite phases become small with equigranular grains and austenite grains having an average transverse grain diameter in the rolling stretcher section of at most 350 μm can be easily formed.

(3) Hot Rolling

Increasing the heating temperature for hot rolling and specifically making it exceed 1200° C. is desirable from the standpoint of increasing the volume percent of ferrite phases.

Regarding the rolling direction, it is preferable to employ a rolling method in which in the first heat, the stainless steel is rolled in such a rolling direction that the direction which becomes the width of the stainless steel at the time of finishing (at the completion of rolling) becomes the primary direction of elongation, and the subsequent rolling is carried out after the stainless steel which underwent the first rolling is rotated by 90° (below, this rolling method will be referred to as first heat cross rolling) In this method, rolling is also applied in the direction which becomes the width at the time of finishing, so the transverse grain diameters of austenite grains after finishing can be decreased.

The reheating temperature before finish rolling is preferably made at least 1100° C. from the standpoint of increasing the volume percent of ferrite phases.

(4) Cold Rolling, Solution Heat Treatment

If necessary, cold rolling may be carried out on the hot-rolled steel sheet. By cold rolling in which working is carried out at a temperature below the recrystallization temperature, it is possible to impart working strains to the steel sheet. The working strains which are imparted by cold rolling become nuclei for recrystallization during subsequent solution heat treatment, making it possible to refine crystal grains. As a result, the transverse grain diameter of austenite can be made small.

There are no particular limitations on the conditions for solution heat treatment, but it is preferable to increase the treatment temperature from the standpoint of increasing the volume percent of ferrite phases.

EXAMPLES

Example 1

The results of investigating the effect of the steel composition on corrosion resistance and weldability (changes in hardness) are shown below.

150 kg of each of the stainless steels having the compositions shown in Table 1 (in mass %, remainder of Fe and unavoidable impurities) were prepared in a vacuum induction melting furnace. Each steel was heated to 1250° C., and then it was formed into an ingot having a thickness of 80 mm by hot forging. Hot rolling with three heats (the first heat was not cross rolling) was then carried out so as to obtain a steel sheet with a thickness of 10 mm. When the steel temperature during hot rolling became 950° C. or less, the sheet was reheated to 1150° C. Solution heat treatment (heating for 25 minutes at 1120° C. followed by water cooling) was then carried out, and test pieces having prescribed dimensions were cut from the steel to perform a corrosion test and a weldability test thereon.

TABLE 1

| | C | Si | Mn | P | S | Ni | Cr | Mo | W | N | Al | O | |
|---|---|---|---|---|---|---|---|---|---|---|---|---|---|
| No. 1 | 0.017 | 0.23 | 0.48 | 0.018 | 0.0004 | 6.69 | 25.12 | 3.32 | 2.67 | 0.31 | 0.017 | 0.006 | In |
| No. 2 | 0.015 | 0.21 | 0.54 | 0.017 | 0.0012 | 6.84 | 27.35 | 0.21 | 0.46 | 0.41 | 0.022 | 0.008 | |
| No. 3 | 0.019 | 0.22 | 0.43 | 0.019 | 0.0003 | 8.10 | 27.56 | 0.92 | 1.42 | 0.38 | 0.019 | 0.007 | |
| No. 4 | 0.020 | 0.19 | 0.46 | 0.016 | 0.0005 | 9.20 | 27.45 | 0.89 | 2.27 | 0.42 | 0.018 | 0.009 | |
| No. 5 | 0.019 | 0.20 | 0.43 | 0.018 | 0.0003 | 7.75 | 27.78 | 0.88 | 2.32 | 0.39 | 0.016 | 0.007 | |
| No. 6 | 0.017 | 0.19 | 0.54 | 0.019 | 0.0004 | 7.65 | 27.97 | 1.21 | 2.44 | 0.44 | 0.019 | 0.008 | |
| No. 7 | 0.020 | 0.21 | 0.48 | 0.017 | 0.0005 | 7.72 | 26.81 | 2.88 | 1.68 | 0.37 | 0.010 | 0.009 | |
| No. 8 | 0.017 | 0.19 | 0.44 | 0.018 | 0.0006 | 7.81 | 27.43 | 0.87 | 2.8 | 0.40 | 0.017 | 0.007 | |
| No. 9 | 0.016 | 0.10 | 0.43 | 0.022 | 0.0006 | 7.49 | 27.66 | 1.71 | 2.2 | 0.48 | 0.016 | 0.008 | |
| No. 10 | 0.017 | 0.22 | 0.48 | 0.022 | 0.0007 | 6.12 | 27.56 | 0.93 | 2.32 | 0.32 | 0.021 | 0.009 | |
| No. 11 | 0.014 | 0.28 | 0.65 | 0.023 | 0.0004 | 7.55 | 27.86 | 0.89 | 2.8 | 0.33 | 0.018 | 0.009 | |
| No. 12 | 0.019 | 0.21 | 1.79 | 0.023 | 0.0005 | 9.79 | 27.55 | 0.78 | 2.62 | 0.38 | 0.019 | 0.008 | |
| No. 13 | 0.018 | 0.20 | 0.53 | 0.025 | 0.0005 | 6.68 | 25.04 | 2.91 | 1.86 | 0.28 | 0.022 | 0.009 | |
| No. 14 | 0.019 | 0.22 | 0.49 | 0.019 | 0.0005 | 9.89 | 27.45 | 0.93 | 2.45 | 0.37 | 0.018 | 0.008 | |
| No. 15 | 0.022 | 0.24 | 0.55 | 0.027 | 0.0014 | 10.1* | 26.55 | 0.89 | 2.34 | 0.45 | 0.022 | 0.005 | Out |
| No. 16 | 0.018 | 0.21 | 0.52 | 0.028 | 0.0022 | 7.21 | 24.72* | 0.92 | 2.43 | 0.42 | 0.019 | 0.007 | |
| No. 17 | 0.014 | 0.20 | 0.49 | 0.022 | 0.0013 | 7.44 | 28.22* | 0.88 | 2.56 | 0.41 | 0.017 | 0.007 | |
| No. 18 | 0.017 | 0.17 | 0.46 | 0.019 | 0.0011 | 7.11 | 27.22 | 3.70* | 2.23 | 0.39 | 0.021 | 0.008 | |
| No. 19 | 0.017 | 0.33 | 0.43 | 0.017 | 0.0010 | 6.89 | 27.89 | 0.92 | 3.18* | 0.41 | 0.018 | 0.006 | |
| No. 20 | 0.016 | 0.21 | 0.55 | 0.021 | 0.0008 | 7.52 | 27.23 | 0.88 | 2.26 | 0.55* | 0.017 | 0.007 | |
| No. 21 | 0.026 | 0.22 | 0.42 | 0.018 | 0.0004 | 5.71* | 27.96 | 1.92 | 2.05 | 0.44 | 0.017 | 0.008 | |
| No. 22 | 0.018 | 0.24 | 2.12* | 0.017 | 0.0018 | 7.23 | 27.23 | 0.88 | 2.13 | 0.42 | 0.016 | 0.009 | |

(note)
In: inside the range of the present invention;
Out: outside the range of the present invention Values with an asterisk in Table 1 are values outside the range for the chemical composition according to the present invention.

In addition to the steels having the compositions shown in Table 1, a sheet of SUS 316 L with a thickness of 15 mm and a sheet of SUS 329J4L with a thickness of 10 mm were obtained from the market as conventional materials and were tested for the purpose of comparison.

Test 1 (Corrosion Test)

A test piece measuring 10 mm wide×40 mm long×3 mm thick was cut from each steel sheet after solution heat treatment, and wet grinding of the entire surface was carried out using 600 grit sandpaper. A corrosion test was carried out by placing the test piece after grinding into an autoclave containing a corrosive solution for testing (having a composition of 48% NaOH) maintained at 170° C. and leaving the test piece in the autoclave for 76 hours.

After the elapse of 76 hours, the weight of the test piece was measured, and the weight loss per unit area and unit time obtained based on a comparison with the weight before testing was made the corrosion weight loss (in $g/m^2$-hr). Cases in which the corrosion weight loss was superior to that of commercially available SUS 447J1 were evaluated as good.

Test 2 (Weldability Test)

A test piece measuring 25 mm wide×40 mm long×12 mm thick was cut from each steel sheet after solution heat treatment. After the Vickers hardness of this test piece was measured, the test piece was subjected to heat treatment corresponding to a weld heat affected zone (heating for 30 minutes at 800° C. followed by water cooling).

The Vickers hardness of the test piece after heat treatment was measured, and the change in hardness of the heat affected zone (ΔHv) was determined.

The results of the above-described evaluation are shown in Table 2 together with the results of evaluation for test pieces made of commercially available steels.

TABLE 2

| | Results of corrosion test (corrosion weight loss, $g/m^2 \cdot hr$) | Results of weldability, increase in hardness (ΔHv) | Remarks | Category |
|---|---|---|---|---|
| SUS 316L | Occurrence of corrosion cracking, Weight loss was unmeasurable | — | | Comparative materials |
| SUS 329J4L | 14.42 | — | | |
| No. 1 | 1.632 | 91 | | This invention |
| No. 2 | 1.367 | 38 | | |
| No. 3 | 0.987 | 32 | | |
| No. 4 | 0.978 | 39 | | |
| No. 5 | 0.986 | 43 | | |
| No. 6 | 0.942 | 74 | | |
| No. 7 | 0.965 | 38 | | |
| No. 8 | 0.933 | 42 | | |
| No. 9 | 0.976 | 37 | | |
| No. 10 | 0.988 | 41 | | |
| No. 11 | 0.925 | 39 | | |
| No. 12 | 1.824 | 44 | | |
| No. 13 | 1.839 | 38 | | |
| No. 14 | 1.989 | 44 | | |
| No. 15 | 3.345 | 67 | | Outside the range of this invention |
| No. 16 | 3.267 | 74 | | |
| No. 17 | 0.965 | 163 | Poor workability | |
| No. 18 | 1.248 | 189 | Mo: too high | |
| No. 19 | 0.945 | 109 | W: too high | |
| No. 20 | 1.134 | 129 | Blowholes found in welds | |
| N0. 21 | 1.648 | 138 | | |
| No. 22 | 2.361 | 75 | | |

In Table 2, corrosion resistance was considered as acceptable when the corrosion weight loss was 2.0 $g/m^2$-hr or less. A value of ΔHv (the change in hardness) of 100 or less was considered an acceptable increase in hardness.

Test No. 17 was evaluated as having "poor workability" because edge cracks developed during rolling after the third heat and rolling with 5 heats was necessary, so this material was evaluated as being outside the present invention.

The results of steels according to this invention will be discussed below.

Test pieces having a steel composition within the range of the present invention had good resistance to corrosion by concentrated alkali with a corrosion weight loss of 2.0 $g/m^2$-hr or less. In the weldability test, the change in hardness (ΔHv) was 100 or less. The main cause of an increase in hardness was the formation of sigma (σ) phases which is due to the effect of weld heat and which becomes the cause of embrittlement and the like. In the range of the present invention, the increase in hardness is small and weldability is regarded as good.

The results of Example 1 will be further discussed.

(1) Mo Content

No. 18 had a Mo content exceeding the range for the present invention, resulting in the formation of a large amount of sigma (σ) phases by heat treatment corresponding to a heat affected zone. Therefore, the heated portion became hard thereby causing embrittlement. No. 1 had a Mo content close to its upper limit, and the increase in hardness after the weldability test was 91, which was close to 100. In order to stably form ferrite phases, it is necessary that the Mo content be at least 0.2 mass %, as in No. 2.

(2) W Content

No. 19 was a material which exceeded the upper limit for the W content. Since this material contained a large amount of W, it had excellent corrosion resistance to concentrated alkalis. However, because the increase in hardness after a weldability test exceeded 100, it had problems with respect to weldability. From the standpoint of weldability, the W content is preferably at most 3.0 mass %.

(3) Mn Content

A Mn content exceeding 2.0 mass % leads to a deterioration in corrosion resistance. The corrosion weight loss of No. 22 exceeded 2.0 $g/m^2$-hr. On the other hand, when the Mn content does not exceed the upper limit as in No. 12, the corrosion weight loss became 2.0 $g/m^2$-hr or less.

(4) Ni Content

Ni is an element which is necessary for forming an austenite phase. However, in the case of a duplex stainless steel, if the Ni content is too high, the resistance to high-temperature concentrated alkali decreases. Therefore, the upper limit on the Ni content is 10.0 mass %. No. 15, which had a Ni content exceeding 10.0 mass %, had a large corrosion weight loss.

(5) Cr Content

Cr is a ferrite-forming element and has the effect of increasing corrosion resistance. If its content is less than 25.0 mass %, it is not possible to impart corrosion resistance which can resist a severely corrosive environment such as a high-temperature concentrated alkali environment. Preferably the Cr content is at least 26.0 mass %. Cr also has the effect of promoting sigma (σ) phase precipitation, so if the Cr content becomes 28.0 mass % or above, sigma (σ) phases precipitate in heat affected zones such as welds, resulting in deterioration in corrosion resistance. No. 17, which had a Cr content exceeding the upper limit, had excellent corrosion resistance, but it had the problem that the increase in hardness in the weldability test was large. No. 16, which had a Cr content less than the lower limit, had a corrosion weight loss exceeding 2.0 $g/m^2$-hr in a high-temperature concentrated alkali environment.

(6) N Content

N is an element which promotes the formation of austenite and imparts an increase in corrosion resistance. However, a material which contains a large amount of N forms blowholes at the time of welding, and increases the hardness of welds due to the formation of nitrides. Accordingly, the N content is made less than 0.5%. No. 20, which had a content of at least 0.5%, had poor weldability.

(7) More Preferred Range

Materials characterized by having a steel composition containing Cr: at least 26.0% to at most 27.95%, Mo: 0.5-3.0%, Mo+W: at least 1.0% to at most 5.0%, Mn: at most 1.7%, and Ni: at least 6.0% to at most 9.5% (No. 3, No. 4, No. 5, No. 7, No. 8, No. 9, No. 10, and No. 11) exhibited good properties expressed by a corrosion weight loss of not greater than 1.0 $g/m^2$-hr and an increase in hardness (ΔHv) of not greater than 50.

Example 2

The following example was carried out in order to clarify the effects of the ferrite content, the ferrite phase number, and the average transverse grain diameter of austenite grains in a stainless steel sheet.

150 kg of stainless steel having the composition of No. 5 shown in Table 1 were melted in a vacuum induction melting furnace to obtain a mother ingot. This ingot was used to prepare materials having various structures by varying the following working steps.

Table 3 shows the manufacturing processes used for the steel sheets. The test steel sheets in Example 1 were prepared by method A in Table 3.

TABLE 3

| | | Forging | | Hot rolling | | | | Cold rolling | | Solution heat treatment | |
|---|---|---|---|---|---|---|---|---|---|---|---|
| | Casting | Temp. (° C.) | Finished size (mm) | Heating temp. in 1st heat (° C.) | Cross rolling in 1st heat | Reheating temp. (° C.) | Finished thickness (mm) | Reduction (%) | Finished thickness (mm) | Heating temp. (° C.) × time (min.) | Cooling method |
| A | 150 kg/ch round ingot | 1250 | 80 | 1250 | none | 1150 | 10 | none | none | 1120° C. × 25 min | Water cooling |
| B | | 1250 | 60 | 1250 | 60→40 | 1150 | 10 | none | none | 1120° C. × 25 min | Water cooling |
| C | | 1250 | 60 | 1250 | 60→40 | 1150 | 12.5 | 20 | 10 | 1120° C. × 25 min | Water cooling |
| D | | 1250 | 60 | 1250 | none | 1150 | 10 | none | none | 1080° C. × 25 min | Water cooling |
| E | | 1250 | 60 | 1250 | none | 1150 | 10 | none | none | 1150° C. × 25 min | Water cooling |
| F | | 1250 | 60 | 1250 | none | 1150 | 10 | none | none | 1120° C. × 25 min | Water cooling |
| G | | 1250 | 60 | 1250 | none | 1150 | 12.5 | 20 | 10 | 1120° C. × 25 min | Water cooling |
| H | | 1250 | 40 | 1250 | none | 1150 | 10 | none | none | 1120° C. × 25 min | Water cooling |
| I | | 1200 | 80 | 1200 | none | 1150 | 10 | none | none | 1120° C. × 25 min | Water cooling |
| J | | 1200 | 60 | 1200 | none | 1150 | 12.5 | 20 | 10 | 1120° C. × 25 min | Water cooling |
| K | | 1200 | 60 | 1200 | none | 1150 | 10 | none | none | 1080° C. × 25 min | Water cooling |

The resulting steel sheets (Tests Nos. 5 and 23-32) were evaluated in the following manner.

(1) Ferrite Content

The ferrite content of each test steel sheet was measured using a Feritscope MP 30E-S manufactured by Fischer Instruments K. K.

(2) Ferrite Phase Number

Each stainless steel sheet was cut so as to obtain a rolling stretcher section. The resulting stainless steel sheet having a rolling stretcher section was further cut to obtain an observation sample including a rolling stretcher section in its surface region. This observation sample was pretreated by embedding in a resin and then subjected to polishing and etching to prepare an observation surface including a rolling stretcher section in its surface region. The observation surface was continuously observed in the thickness direction at a magnification of 400× using an electron microscope, and the resulting plurality of observation images were connected to prepare an image including the surface region. An arbitrary point on the surface of the steel sheet in this image was selected as a starting point for measurement, and a point which was spaced from this starting point of measurement by 0.5 mm in the thickness direction of the steel sheet towards the center was made the end point for measurement. A measurement line connecting the starting point of measurement and the end point of measurement was drawn, and the number of ferrite phases which crossed this measurement line was counted as the ferrite phase number. For each test steel sheet, 10 different measurement lines were drawn and the ferrite phase number was counted for each line, and of the resulting ferrite phase number for the 10 lines, the arithmetic mean for 8 lines excluding the maximum and minimum values was made the ferrite phase number in the steel sheet.

(3) Average Transverse Grain Diameter

A portion of the observation surface for the rolling stretcher section obtained by the above method was observed at a magnification of 200× using an electron microscope, and the length of the major axis of at least 5 austenite grains in one field of view was measured. Of the data measured for at least 5 major axes, the arithmetic mean was calculated for data (at least 3 points) excluding the minimum and maximum values. For one test steel sheet, 9 rolling stretcher sections were prepared, the observation surface in the rolling stretcher section was observed for each cross section, and the arithmetic mean of the length of the major axis was obtained for each cross section. The arithmetic mean of the resulting plurality of arithmetic means was determined and was made the average transverse grain diameter of the austenite grains of the steel sheet.

(4) Corrosion Weight Loss

The corrosion weight loss was measured for each test steel sheet by the method described in Example 1.

Figure 2:
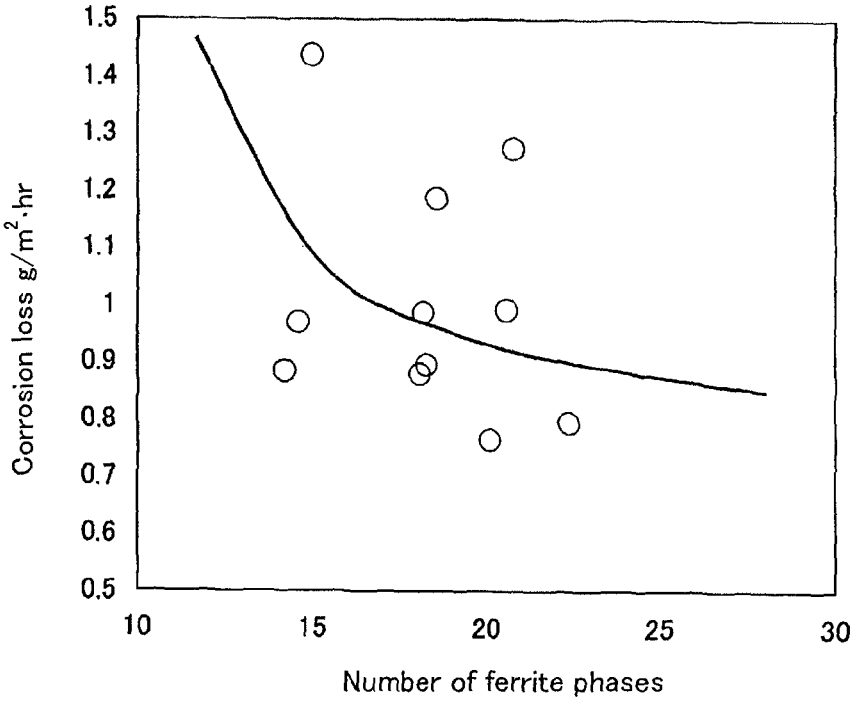
FIG. 2 is a graph showing the dependence of the corrosion weight loss on the number of ferrite phases in a test steel sheet of Example 1.
Figure 3:
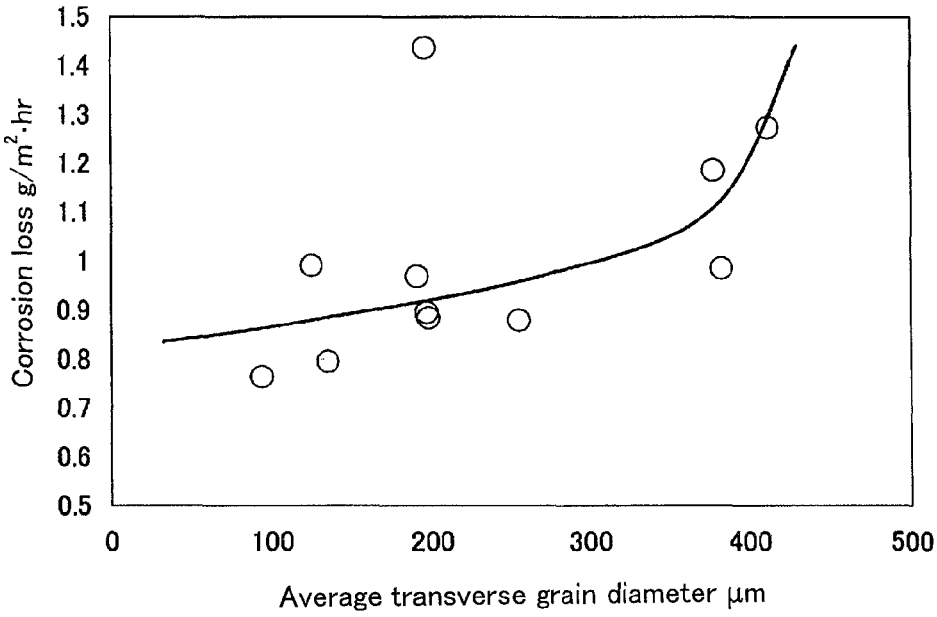
FIG. 3 is a graph showing the dependence of the corrosion weight loss on the average length of the major axis of austenite grains in a rolling lengthwise cross section of a test steel sheet of Example 1.

The results of the above evaluation are shown in Table 4. The dependence of the corrosion weight loss on the ferrite content, the ferrite phase number, and the average transverse grain diameter of austenite grains in a rolling stretcher section is shown in FIG. 1, FIG. 2, and FIG. 3, respectively.

When a steel sheet had a ferrite content of at least 40 mass %, a ferrite phase number of at least 15, and an average transverse grain diameter of austenite of not greater than 350 μm, the corrosion weight loss was approximately 1.1 $g/m^2$-hr or lower and was considered excellent.

TABLE 4

| Test No. | Steel composition | Manufacturing method | Ferrite content (mass %) | Ferrite phase number | Average transverse grain diameter (μm) | Result of corrosion test (corrosion weight loss, g/m$^2$-hr) | Comments |
|---|---|---|---|---|---|---|---|
| No. 5 | No. 5 | A | 43.1 | 18.2 | 383 | 0.986 | Method of Example 1 |
| No. 23 | | B | 43.3 | 18.3 | 197 | 0.895 | |
| No. 24 | | C | 43.6 | 20.1 | 94 | 0.764 | |
| No. 25 | | D | 41.8 | 14.6 | 191 | 0.969 | |
| No. 26 | | E | 44.8 | 14.2 | 198 | 0.884 | |
| No. 27 | | F | 43.2 | 18.1 | 255 | 0.879 | |
| No. 28 | | G | 43.4 | 22.4 | 135 | 0.795 | |
| No. 29 | | H | 43.1 | 20.8 | 412 | 1.274 | |
| No. 30 | | I | 40.8 | 18.6 | 378 | 1.186 | |
| No. 31 | | J | 40.8 | 20.6 | 125 | 0.991 | |
| No. 32 | | K | 39.3 | 14.8 | 196 | 1.437 | |

The invention claimed is:

1. A duplex stainless steel for use in applications requiring alkali resistance having a chemical composition comprising, in mass %, C: at most 0.03%, Si: at most 0.5%, Mn: at most 2.0%, P: at most 0.04%, S: at most 0.003%, Cr: at least 25.0% to less than 28.0%, Ni: at least 6.0% to at most 10.0%, Mo: at least 0.2% to at most 3.5%, N: less than 0.5%, W: at most 3.0%, and a remainder of Fe and impurities, wherein the duplex stainless steel is rolled and it has an average transverse grain diameter of austenite grains in a rolling stretcher section of at most 350 μm.

2. A duplex stainless steel as set forth in claim 1 characterized in that the ferrite content of the duplex stainless steel is at least 40 mass %.

3. A duplex stainless steel as set forth in claim 1 characterized in that the number of ferrite phases present in a region between the surface of the duplex stainless steel and a depth of 0.5 mm from the surface is at least 15.

4. A duplex stainless steel as set forth in claim 2 characterized in that the number of ferrite phases present in a region between the surface of the duplex stainless steel and a depth of 0.5 mm from the surface is at least 15.

5. The duplex stainless steel as set forth in claim 1, wherein a content of Mo+W is 1.0 to 5.0%.

6. A duplex stainless steel for use in applications requiring alkali resistance having a chemical composition consisting essentially of, in mass %, C: at most 0.03%, Si: at most 0.5%, Mn: at most 2.0%, P: at most 0.04%, S: at most 0.003%, Cr: at least 25.0% to less than 28.0%, Ni: at least 6.0% to at most 10.0%, Mo: at least 0.2% to at most 3.5%, N: less than 0.5%, W: at most 3.0%, and a remainder of Fe and impurities, wherein the duplex stainless steel is rolled and it has an average transverse grain diameter of austenite grains in a rolling stretcher section of at most 350 μm.

7. A duplex stainless steel as set forth in claim 6 characterized in that the ferrite content of the duplex stainless steel is at least 40 mass %.

8. A duplex stainless steel as set forth in claim 6 characterized in that the number of ferrite phases present in a region between the surface of the duplex stainless steel and a depth of 0.5 mm from the surface is at least 15.

9. A duplex stainless steel as set forth in claim 7 characterized in that the number of ferrite phases present in a region between the surface of the duplex stainless steel and a depth of 0.5 mm from the surface is at least 15.

10. The duplex stainless steel as set forth in claim 6, wherein a content of Mo+W is 1.0 to 5.0%.

* * * * *